US008953827B2

(12) United States Patent
Sacha et al.

(10) Patent No.: US 8,953,827 B2
(45) Date of Patent: Feb. 10, 2015

(54) HEARING AID WITH INTEGRATED TELECOIL AND BATTERY RECHARGE COIL

(75) Inventors: Michael Karl Sacha, Chanhassen, MN (US); James R. Newton, Burnsville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 146 days.

(21) Appl. No.: 13/421,292

(22) Filed: Mar. 15, 2012

(65) Prior Publication Data

US 2012/0314893 A1 Dec. 13, 2012

Related U.S. Application Data

(60) Provisional application No. 61/454,516, filed on Mar. 19, 2011.

(51) Int. Cl.
*H04R 25/00* (2006.01)

(52) U.S. Cl.
CPC ..... *H04R 25/55* (2013.01); *H04R 25/554* (2013.01); *H04R 2225/31* (2013.01)
USPC ..... 381/323; 381/315

(58) Field of Classification Search
CPC .. H04R 25/558; H04R 25/554; H04R 25/505; H04R 25/602; H04R 2225/31; H04R 2225/61
USPC ..... 381/323, 315; 607/57
See application file for complete search history.

(56) References Cited

U.S. PATENT DOCUMENTS

| | | | | |
|---|---|---|---|---|
| 6,308,101 | B1 * | 10/2001 | Faltys et al. | 607/57 |
| 6,473,511 | B1 * | 10/2002 | Aceti et al. | 381/322 |
| 6,658,124 | B1 * | 12/2003 | Meadows | 381/323 |
| 7,206,426 | B1 * | 4/2007 | Julstrom et al. | 381/331 |
| 7,256,747 | B2 * | 8/2007 | Victorian et al. | 343/718 |
| 7,446,720 | B2 * | 11/2008 | Victorian et al. | 343/718 |
| 8,587,488 | B2 * | 11/2013 | Knudsen et al. | 343/728 |
| 2002/0076071 | A1 * | 6/2002 | Single | 381/312 |
| 2005/0075697 | A1 * | 4/2005 | Olson et al. | 607/61 |
| 2006/0155346 | A1 * | 7/2006 | Miller | 607/57 |
| 2008/0170733 | A1 * | 7/2008 | Reithinger | 381/315 |
| 2008/0205678 | A1 | 8/2008 | Boguslavskij et al. | |
| 2008/0228243 | A1 * | 9/2008 | Maltan et al. | 607/57 |
| 2009/0067652 | A1 * | 3/2009 | Schmidt et al. | 381/314 |

(Continued)

FOREIGN PATENT DOCUMENTS

| | | | |
|---|---|---|---|
| EP | 2503796 | B1 | 5/2014 |
| JP | 2009021910 | A | 1/2009 |

OTHER PUBLICATIONS

"European Application Serial No. 12160095.1, Extended European Search Report mailed Jul. 12, 2012", 5 pgs.

(Continued)

*Primary Examiner* — Matthew Eason
*Assistant Examiner* — Sean H Nguyen
(74) *Attorney, Agent, or Firm* — Schwegman Lundberg & Woessner, P.A.

(57) ABSTRACT

A hearing aid is powered by a rechargeable battery and senses a sound signal being a magnetic field using a telecoil. The hearing aid includes a battery recharge coil for receiving power from a hearing aid charger via an inductive couple. The telecoil and the inductive coil are integrated into a single device.

20 Claims, 3 Drawing Sheets

(56) References Cited

U.S. PATENT DOCUMENTS

| | | | | |
|---|---|---|---|---|
| 2009/0085408 | A1* | 4/2009 | Bruhn | 307/104 |
| 2009/0143097 | A1* | 6/2009 | Wilson | 455/556.1 |
| 2009/0285426 | A1* | 11/2009 | Boguslavskij | 381/323 |
| 2009/0296947 | A1* | 12/2009 | Duron et al. | 381/71.6 |
| 2010/0030301 | A1* | 2/2010 | Parker et al. | 607/57 |
| 2010/0224356 | A1* | 9/2010 | Moore | 166/65.1 |
| 2011/0084653 | A1* | 4/2011 | Julstrom et al. | 320/108 |
| 2011/0106210 | A1* | 5/2011 | Meskens | 607/57 |
| 2011/0311084 | A1* | 12/2011 | Drader | 381/315 |
| 2011/0319703 | A1* | 12/2011 | Wiskerke et al. | 600/25 |
| 2013/0127404 | A1* | 5/2013 | Maenpaa | 320/108 |

OTHER PUBLICATIONS

"European Application Serial No. 12160095.1, Response filed Mar. 26, 2013 to Extended European Search Report mailed Jul. 12, 2012", 6 pgs.

* cited by examiner

HEARING AID WITH INTEGRATED TELECOIL AND BATTERY RECHARGE COIL

RELATED APPLICATION

The present application claims the benefit under 35 U.S.C. 119(e) of U.S. Provisional Patent Application Ser. No. 61/454,516, filed Mar. 19, 2011, which is incorporated herein by reference in its entirety.

TECHNICAL FIELD

This document relates generally to hearing assistance systems and more particularly to a hearing aid with an integrated coil assembly that includes a telecoil for sensing a sound signal and a battery recharge coil for receiving power through an inductive couple for charging a rechargeable battery.

BACKGROUND

Hearing aids are used to assist patients suffering hearing loss by transmitting amplified sounds to ear canals. In one example, a hearing aid is worn in and/or around a patient's ear. Patients generally prefer that their hearing aids are minimally visible or invisible. Because adding or improving functionality of the hearing aid may require larger and/or additional components, there is a need to provide such components without substantially increasing the overall size of the hearing aid.

SUMMARY

A hearing aid is powered by a rechargeable battery and senses a sound signal being a magnetic field using a telecoil. The hearing aid includes a battery recharge coil for receiving power from a hearing aid charger via an inductive couple.

In one embodiment, the hearing aid includes a coil assembly, a processor, a receiver, a rechargeable battery, and a charging circuit. The coil assembly integrates the telecoil and the battery recharge coil. The telecoil generates a sound signal in response to a sound magnetic field. The recharge coil generates a power signal in response to a power magnetic field. The processor processes the sound signal. The receiver delivers the processed sound signal to the ear canal. The charging circuit charges the rechargeable battery using the power signal.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
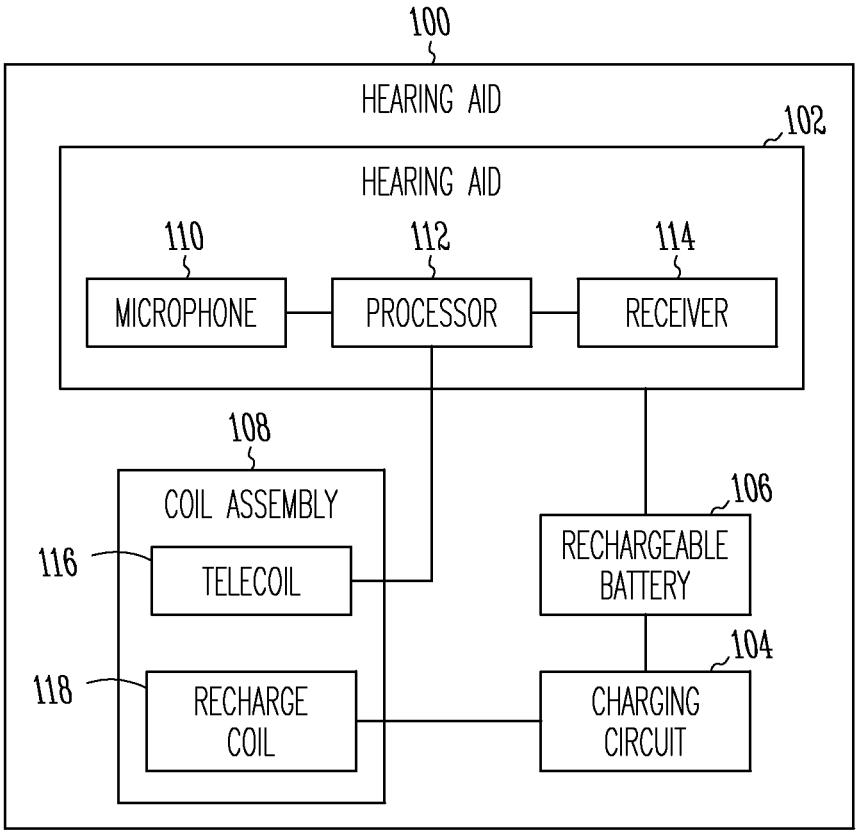
FIG. 1 is a block diagram illustrating an embodiment of a hearing aid including an integrated coil assembly.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing aid that is powered by a rechargeable battery and includes a magnetic sensor and a battery recharge coil. The magnetic sensors picks up sounds transmitted as magnetic signals. A telecoil, also referred to as a T-coil, T-switch, or a telephone switch, is such a magnetic sensor that senses a magnetic signal representing a sound and, in response, generates a sound signal being an electrical signal representing the sound. The sound signal causes a receiver (speaker) of the hearing aid to deliver the sound to an ear canal of a wearer. The magnetic signal may be generated from, for example, a hearing aid compatible telephone, an assistive listening system, or an assistive listening device. A hearing aid may turn off its microphone when its telecoil is turned on, such that the wearer hears the sound represented by the magnetic signal but not acoustic noises. The telecoil also eliminates acoustic feedback associated with using the microphone of the hearing aid to listen to a telephone.

Use of the rechargeable battery reduces the cost and replacement frequency associated with using a non-rechargeable battery. Cordless charging technology provides the patient with an easy way to recharge the hearing aid. A known method to provide cordless charging of the rechargeable battery is inductive charging in which power is transmitted from a hearing aid charger to the hearing aid through an inductive couple. The inductive couple is formed by a transmitting coil (as referred to as the primary coil) in the hearing aid charger placed in proximity of the battery recharge coil (also referred to as the secondary coil) in the hearing aid. Fully recharging the rechargeable battery through an inductive couple may take several hours. This charging period may be shortened by increasing the diameter of the battery recharge coil, increasing the number of turns of the battery recharge coil, increasing the size of the wire used to form the battery recharge coil, and/or adding a permeable core to the battery recharge coil. However, all these approaches increases the size of the secondary coil and hence the size of the hearing aid.

The present hearing aid includes a coil assembly that integrates the telecoil with the battery recharge coil, thereby reducing the overall component count and size for the hearing aid, and/or improving the power transfer efficiency of the inductive couple by providing a better-performing battery recharge coil. In one embodiment, a battery recharge coil is added to a telecoil by adding windings to the telecoil. This may allow, for example, the number of turns of the battery recharge coil to be increased and/or a permeable core to be included for the battery recharge coil, with a possible increase in the size of the battery recharge coil being compensated by the improved power transfer efficiency of the inductive couple.

FIG. 1 is a block diagram illustrating an embodiment of a hearing aid 100 including a hearing aid circuit 102, a charging circuit 104, a rechargeable battery 106, and an integrated coil assembly 108. Coil assembly 108 includes a telecoil 116 and a recharge coil 118, which are integrated into a single device. Telecoil 116 generates a sound signal in response to a sound magnetic field representing a sound. The sound signal is an electrical signal representing the sound. Recharge coil 118 is a battery recharge coil that generates a power signal in response to a power magnetic field generated from a hearing aid charger. The power signal is an electrical signal carrying the power for charging rechargeable battery 106.

Hearing aid circuit 102 includes a microphone 110 to receive an audio signal, a processor 112 to process the audio signal and the sound signal, and a receiver (speaker) 114 to deliver the processed audio signal and sound signal as sounds to the ear canal of the wearer of hearing aid 100. In one embodiment, processor 112 includes a digital signal processor. Rechargeable battery 106 supplies hearing aid 100 with electrical power for its operation. Examples of rechargeable battery include nickel metal hydride, nickel cadmium, lithium air, lithium ion (standard, thin-film or nano-structure), lithium polymer (standard or advanced), lithium sulphur, silver-zinc, and super capacitor type batteries. Charging circuit 104 converts the power signal generated by recharge 118 into a DC signal suitable for charging rechargeable battery 106.

Figure 2:
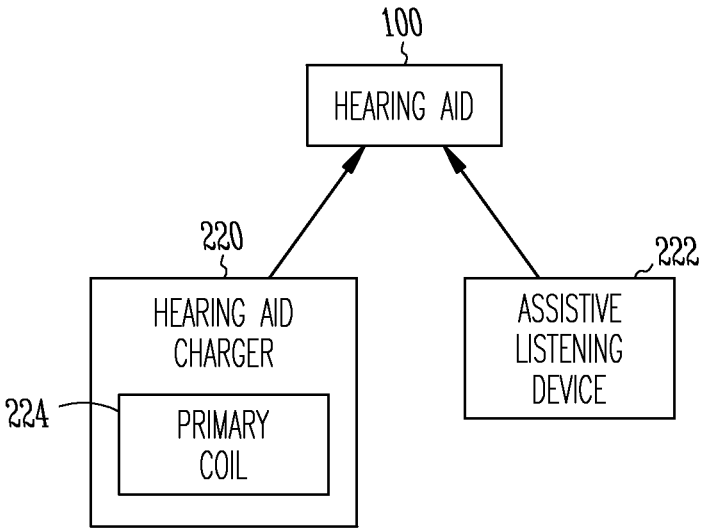
FIG. 2 is a block diagram illustrating an embodiment of a hearing assistance system including the hearing aid.

FIG. 2 is a block diagram illustrating an embodiment of a hearing assistance system including hearing aid 100, a hearing aid charger 220, and an assistive listening device 222. Hearing aid charger 220 includes a primary coil 224 to generate the power magnetic field. Primary coil 224 is driven by a coil driver circuit including a power amplifier. In one embodiment, a tuning circuit is provided between primary coil 224 and the coil driver. In one embodiment, hearing aid charger 220 is powered using a household AC power line.

Assistive listening device 222 represents a device that generates the sound magnetic field. One example of assistive listening device 222 includes a hearing aid compatible telephone. In various embodiments, assistive listening device 222 includes any device that generates the sound magnetic field that is to be sensed by telecoil 116 in hearing aid 100.

Figure 3:
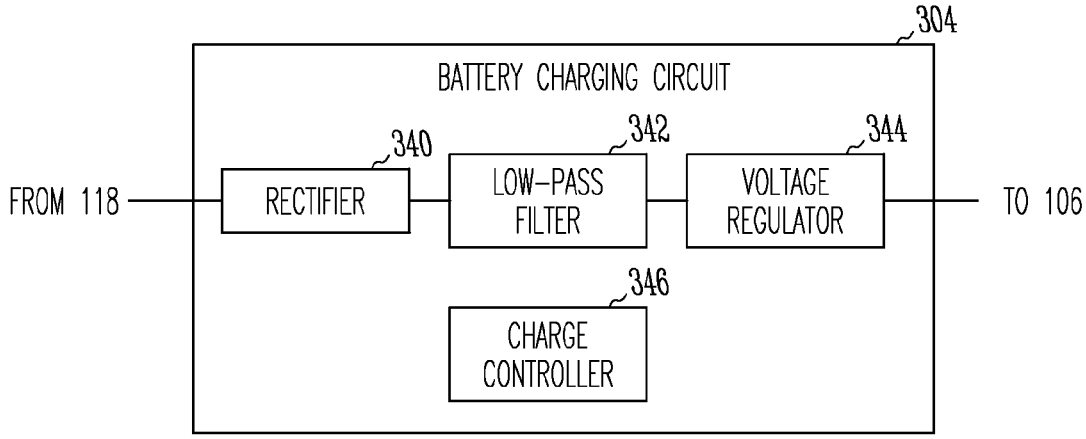
FIG. 3 is an illustration of an embodiment of a battery charging circuit of the hearing aid.

FIG. 3 is an illustration of an embodiment of a battery charging circuit 304. Battery charging circuit 304 represents an embodiment of charging circuit 104 and includes a rectifier 340, a low-pass filter 342, a voltage regulator 344, and optionally a charge controller 346. The power magnetic field generated by hearing aid charger 220 is an AC magnetic field, and the power signal generated by recharge coil 118 in response is an AC electrical signal. Battery charging circuit 304 converts this AC signal to a DC signal suitable for charging rechargeable battery 106. Rectifier 340 rectifies the power signal. Low-pass filter 342 converts the power signal to a signal with a substantial DC component. Voltage regulator 344 limits the output voltage of battery charging circuit 304 to a level suitable for charging rechargeable battery 106. In one embodiment, charging controller 346 controls the operation of battery charging circuit 304, such as whether and when to charge rechargeable battery 106 for its optimal performance.

Figure 4:
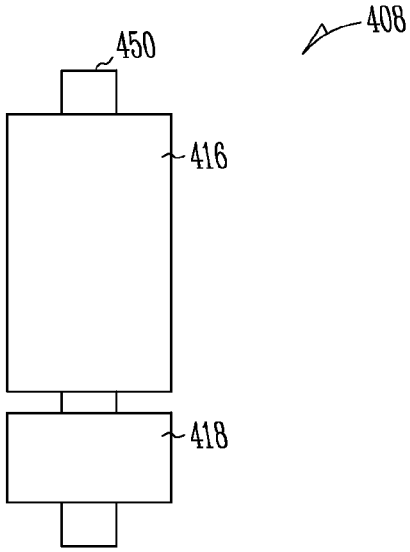
FIG. 4 is an illustration of an embodiment of the integrated coil assembly.

FIG. 4 is an illustration of an embodiment of the integrated coil assembly 408. Coil assembly 408 represents an embodiment of coil assembly 108 and includes a telecoil 416 and a recharge coil 418. Telecoil 416 represents an embodiment of telecoil 116 and is formed by winding a wire on a core 450. Recharge coil 418 represents an embodiment of recharge coil 416 and is formed by winding another wire on the same core 450. Thus, telecoil 416 and recharge coil 418 are integrated by winding separate wires on the same core. In one embodiment, core 450 is a metallic core. Recharge coil 418 may occupy a larger space when compared to, for example, a battery recharge coil formed by copper traces on a printed circuit board. However, the lost aperture may be compensated by the improved power transfer efficiency due to the use of a permeable core and the additional number of turns of recharge coil 418 allowed in the illustrated embodiment. 2

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid for delivering sounds to an ear canal, comprising:

a coil assembly including a core, a telecoil formed by a first wire wound on the core, and a recharge coil formed by a second wire wound on the core, the first and second wires being separate wires, the telecoil configured to generate a sound signal in response to a sound magnetic field, the recharge coil configured to generate a power signal in response to a power magnetic field;

a processor coupled to the telecoil, the processor configured to process the sound signal;

a receiver coupled to the processor, the receiver configured to deliver the processed sound signal to the ear canal;

a rechargeable battery; and a charging circuit coupled between the recharge coil and the rechargeable battery, the charging circuit configured to charge the rechargeable battery using the power signal.

2. The hearing aid of claim 1, wherein the core comprises a permeable core.

3. The hearing aid of claim 1, wherein the core comprises a metallic core.

4. The hearing aid of claim 1, wherein the charging circuit comprise a rectifier, a low-pass filter, and a voltage regulator.

5. The hearing aid of claim 4, wherein the charging circuit further comprises a charge controller configured to control whether and when to charge the rechargeable battery for optimal performance of the rechargeable battery.

6. The hearing aid of claim 1, wherein the processor comprises a digital signal processor.

7. The hearing aid of claim 1, wherein the rechargeable battery comprises a nickel metal hydride type battery, a nickel cadmium type battery, a lithium air type battery, a lithium ion type battery, a lithium polymer type battery, a lithium sulphur type battery, a silver-zinc type battery, or a super capacitor type battery.

8. The hearing aid of claim 1, wherein the hearing aid is a behind-the-ear type hearing aid.

9. The hearing aid of claim 1, wherein the hearing aid is an in-the-ear type hearing aid.

10. The hearing aid of claim 1, wherein the hearing aid is an in-the-canal type hearing aid.

11. The hearing aid of claim 1, wherein the hearing aid is a completely-in-the-canal type hearing aid.

12. The hearing aid of claim 1, wherein the hearing aid is a receiver-in-the-ear type hearing aid.

13. The hearing aid of claim 1, wherein the hearing aid is a receiver-in-canal type hearing aid.

14. A method for operating a hearing aid for delivering sounds to an ear canal, comprising:

generating a sound signal in response to a sound magnetic field using a telecoil wound on a permeable core;

generating a power signal in response to a power magnetic field using a recharge coil wound on the permeable core;

processing the sound signal for delivery to the ear canal; and charging a rechargeable battery of the hearing aid using the power signal, wherein the telecoil and the recharge coil are integrated by winding separate wires on the permeable core.

15. The method of claim 14, comprising generating the sound signal in response to the sound magnetic field generated by an assistive hearing device.

16. The method of claim 15, comprising generating the sound signal in response to the sound magnetic field generated by a hearing aid compatible telephone.

17. The method of claim 14, further comprising controlling whether and when to charge the rechargeable battery for optimal performance of the rechargeable battery.

18. The method of claim 14, wherein processing the sound signal comprises processing the sound signal using a digital signal processor.

19. The method of claim 14, comprising generating the power magnetic field using a hearing aid charger including a primary coil.

20. The method of claim 19, comprising generating the sound magnetic field using an assistive listening device.

* * * * *